US010612819B2

(12) United States Patent
Thomsen et al.

(10) Patent No.: US 10,612,819 B2
(45) Date of Patent: Apr. 7, 2020

(54) PULSATION DAMPER FOR A VAPOUR COMPRESSION SYSTEM

(71) Applicant: DANFOSS A/S, Nordborg (DK)

(72) Inventors: Carsten Mølhede Thomsen, Vejle (DK); Klaus Halldorsson, Kolding (DK); Bjarke Skovgård Dam, Almind (DK)

(73) Assignee: DANFOSS A/S, Nordborg (DK)

( * ) Notice: Subject to any disclaimer, the term of this patent is extended or adjusted under 35 U.S.C. 154(b) by 445 days.

(21) Appl. No.: 15/327,076

(22) PCT Filed: May 27, 2015

(86) PCT No.: PCT/EP2015/061732
§ 371 (c)(1),
(2) Date: Jan. 18, 2017

(87) PCT Pub. No.: WO2016/026592
PCT Pub. Date: Feb. 25, 2016

(65) Prior Publication Data

US 2017/0191703 A1 Jul. 6, 2017

(30) Foreign Application Priority Data

Aug. 21, 2014 (EP) ..... 14181810

(51) Int. Cl.
*F25B 41/06* (2006.01)
*F25B 1/10* (2006.01)

(52) U.S. Cl.
CPC ..... *F25B 1/10* (2013.01); *F25B 41/062* (2013.01); *F25B 2400/13* (2013.01); *F25B 2500/12* (2013.01); *F25B 2500/13* (2013.01)

(58) Field of Classification Search
CPC ..... F25B 2500/13; F25B 2400/16; F25B 2400/23; F25B 2500/12; F04B 11/008;
(Continued)

(56) References Cited

U.S. PATENT DOCUMENTS 5,460,349 A 10/1995 Campbell et al.
5,533,351 A * 7/1996 Miyata ..... F25B 13/00 62/174

(Continued)

FOREIGN PATENT DOCUMENTS

CN 101523135 A 9/2009
CN 102997514 A 3/2013

(Continued)

OTHER PUBLICATIONS

International Search Report for PCT Serial No. PCT/EP2015/061732 dated Aug. 5, 2015.

*Primary Examiner* — David J Teitelbaum
(74) *Attorney, Agent, or Firm* — McCorming, Paulding & Huber PLLC

(57) ABSTRACT

A pulsation damper (1) comprising a first tube (4) and a second tube (5), e.g. arranged concentrically with respect to each other, the first tube (4) being arranged inside the second tube (5). The second tube (5) has a closed end, and the first tube (4) has a second end (7) arranged at a distance from the closed end (8) of the second tube (5). The first tube (4) is fluidly connected to the second tube (5) via the second end (7). The pulsation damper is capable of damping pressure pulses within a broad frequency range. Furthermore a vapour compression system (14) having a pulsation damper (1) arranged in an economizer line (20).

15 Claims, 9 Drawing Sheets

(58) Field of Classification Search
CPC ..... F04B 39/0027; F04B 39/0055; F04B 11/0008
See application file for complete search history.

(56) References Cited

U.S. PATENT DOCUMENTS

| | | | | |
|---|---|---|---|---|
| 6,799,657 | B2 | 10/2004 | Daniels | |
| 2003/0070551 | A1* | 4/2003 | Fisk | B01D 46/0005 96/134 |
| 2004/0231738 | A1 | 11/2004 | Suzuki et al. | |
| 2010/0218536 | A1 | 9/2010 | Rockwell | |
| 2011/0094248 | A1* | 4/2011 | Taras | F25B 1/10 62/115 |

FOREIGN PATENT DOCUMENTS

| | | | |
|---|---|---|---|
| DE | 101 00 315 | C1 | 8/2002 |
| EP | 0 768 464 | A2 | 4/1997 |
| EP | 1498615 | A1 | 1/2005 |
| EP | 2 330 300 | A1 | 6/2011 |
| EP | 1 831 566 | B1 | 10/2012 |
| GB | 2 003 232 | A | 3/1979 |
| JP | 2002225702 | A | 8/2002 |
| WO | 94/09329 | A1 | 4/1994 |
| WO | 2008/045084 | A1 | 4/2008 |

* cited by examiner

PULSATION DAMPER FOR A VAPOUR COMPRESSION SYSTEM

CROSS-REFERENCE TO RELATED APPLICATION

This application is entitled to the benefit of and incorporates by reference subject matter disclosed in the International Patent Application No. PCT/EP2015/061732 filed on May 27, 2015 and European Patent Application No. 14181810.4 filed on Aug. 21, 2014.

TECHNICAL FIELD

The present invention relates to a pulsation damper for damping pressure pulsations in a vapour compression system, such as a refrigeration system, an air condition system or a heat pump. The pressure pulsations being damped may, e.g., originate from a compressor arranged in a refrigerant path of the vapour compression system.

BACKGROUND

During operation of a vapour compression system, such as a refrigeration system, an air condition system or a heat pump, a compressor forming part of the vapour compression system may create pressure pulsations in the refrigerant circulating in the vapour compression system. Such pressure pulsations may result in wear on other components of the vapour compression system, and may even cause damage to such components. Furthermore, the pressure pulsations may create undesirable noise.

It is therefore desirable to either avoid such pressure pulsations, or to ensure that, if pressure pulsations occur, the pressure pulsations are not causing damage to the other components of the vapour compression system. This may, e.g., be obtained by arranging an absorptive muffler in the refrigerant path.

In the case that the compressor is of a type which operates at a fixed speed, the possible pressure pulsations created by the compressor will normally have a fixed frequency or a frequency within a very narrow frequency band. In this case it is possible to design a pulsation damper which is capable of damping the pressure pulsations of the specific frequency or within the narrow frequency interval, e.g. by means of destructive interference.

US 2010/0218536 A1 discloses a resonator arranged in an economizer line of a refrigeration system. The resonator has a first branch and a second branch. A first flow path length across the resonator through the second branch is longer than a second flow path length across the resonator through the first branch. Thereby pulsations in the refrigerant flowing along the two branches will be out of phase when reaching a manifold and will cancel so that less pulsation is transmitted to the housing. The lengths of the branches are selected to match a specific pulsation frequency, and pulsations having a frequency which differs from the specific pulsation frequency will not be cancelled.

EP 1 831 566 B1 discloses a compressor having a housing and including means for limiting pressure pulsations along a branch path, such as an economizer path. Within a wall of the housing, the branch path includes first, second and third legs. The lengths of the legs are tuned to match a specific pulsation frequency, and pulsations having a frequency which differs from the specific pulsation frequency will not be limited.

When a variable speed compressor is applied in a vapour compression system, pressure pulsations having frequencies within a relatively broad frequency band may occur. It is not possible to cancel such pulsations by means of the devices disclosed in US 2010/0218536 A1 and EP 1 831 566 B1.

U.S. Pat. No. 6,799,657 B2 discloses an absorptive and reactive muffler including an annular flow path for the gas with the centre of the annulus having a plurality of resonators which are in open communication with the downstream end of the annular flow path and make up the reactive portion of the muffler. The flow path is at least partially lined by an absorptive material overlain by a perforate material and makes up the absorptive portion of the muffler.

SUMMARY

It is an object of embodiments of the invention to provide a pulsation damper which is capable of damping pressure pulsations within a broad frequency range.

It is a further object of embodiments of the invention to provide a pulsation damper having a simple and compact design.

It is an even further object of embodiments of the invention to provide a vapour compression system, in which pressure pulsations within a broad frequency range can be damped.

It is an even further object of embodiments of the invention to provide a vapour compression system, in which protection against pressure pulsations is provided for the components of the vapour compression system.

According to a first aspect the invention provides a pulsation damper comprising:

- a first connector and a second connector, each arranged to be connected into a fluid flow line in such a manner that fluid is received in the pulsation damper from the fluid flow line via the first or the second connector, and fluid is delivered to the fluid flow line from the pulsation damper via the second or first connector,
- a first tube having a first end being fluidly connected to the first connector and a second end arranged opposite the first end, and
- a second tube, the first tube being arranged inside the second tube, the second tube having a closed end, wherein the second end of the first tube is arranged inside the second tube at a distance from the closed end of the second tube, the first tube being fluidly connected to the second tube, via the second end of the first tube, and the second tube being fluidly connected to the second connector, wherein the pulsation damper defines a fluid flow path through the pulsation damper from the first or second connector to the second or first connector, via the first tube and the second tube.

According to the first aspect the invention provides a pulsation damper, i.e. a device which is capable of damping pressure pulsations in a fluid, such as a refrigerant flowing in a refrigerant path of a vapour compression system. Thus, the pulsation damper may advantageously be mounted in or form part of a vapour compression system, such as a refrigeration system, an air condition system or a heat pump system.

The pulsation damper comprises a first connector and a second connector, each arranged to be connected into a fluid flow line. One of the connectors operates as an inlet connector, and the other connector operates as an outlet connector. Fluid is received in the pulsation damper from the fluid flow line via the connector which operates as an inlet connector. Similarly, fluid is delivered to the fluid flow line from the pulsation damper via the connector which operates as an outlet connector. It is not ruled out that the fluid flow direction through the pulsation damper can be reversed. In this case, the connector which previously operated as an inlet connector will subsequently operate as an outlet connector, and vice versa.

The pulsation damper further comprises a first tube having a first end being fluidly connected to the first connector and a second end arranged opposite the first end. When the first connector operates as an inlet connector, fluid flows from the fluid flow line into the first tube, via the first connector and the first end of the first tube. Similarly, when the first connector operates as an outlet connector, fluid is delivered from the first tube to the fluid flow line, via the first end of the first tube and the first connector.

The pulsation damper further comprises a second tube, the first tube being arranged inside the second tube. The first tube and the second tube may be arranged concentrically with respect to each other. The second tube comprises a closed end, and the second end of the first tube is arranged at a distance from the closed end of the second tube. The first tube is fluidly connected to the second tube, via the second end of the first tube, and the second tube is fluidly connected to the second outlet connector. The second tube may form a housing accommodating the pulsation damper.

Thus, a flow path is defined through the pulsation damper. In the case that the first connector operates as an inlet connector and the second connector operates as an outlet connector, fluid enters the pulsation damper via the first connector, continuing into the first tube via the first end of the first tube, enters the second tube via the second end of the first tube, and finally leaves the pulsation damper via the second connector.

Similarly, in the case that the second connector operates as an inlet connector and the first connector operates as an outlet connector, fluid enters the pulsation damper via the second connector, enters the second tube, continues into the first tube, via the second end of the first tube, and finally leaves the pulsation damper via the first end of the first tube and the first connector.

Since the first tube is arranged inside the second tube, the diameter of the first tube is smaller than the diameter of the second tube. Thereby, when fluid flows from the first tube into the second tube, via the second end of the first tube, the cross sectional dimension of the flow path increases significantly, i.e. there is a discontinuity in the cross sectional dimension of the flow path at this location. Furthermore, a space is defined inside the second tube, between the second end of the first tube and the closed end of the second tube, because the second end of the first tube is arranged at a distance from the closed end of the second tube. This space operates as an expansion chamber inside the pulsation damper.

Pressure pulsations introduced in a fluid flowing in a fluid flow system may propagate in the same direction as the fluid flow, but will most often propagate in a direction opposite to the fluid flow. The pressure pulsations propagate in the same manner as sound waves. When the pressure pulsations reach a discontinuity in the cross sectional dimension of the flow path, or when they reach a wall, the pressure pulsations are reflected. Thereby the distances between positions along the flow path, where the pressure pulsations are reflected, define resonance frequencies of the pulsation damper. The exact resonance frequencies further depend on the speed of sound in the fluid under the prevailing pressure. The damper can thereby be designed in such a manner that destructive interference occurs at the resonance frequencies, and thereby pressure pulsations at these frequencies can be damped.

Thus, the different lengths of the first and second tubes ensure that the pulsation damper is designed to define several distinct resonance frequencies. Thereby the pulsation damper is capable of damping pressure pulsations of several different frequencies. Furthermore, the expansion chamber defined between the second end of the first tube and the closed end of the second tube causes the discrete resonance frequencies to be broadened. As a consequence, the pulsation damper is capable of damping pressure pulsations within a broad frequency range. The lowest frequency of pressure pulsations which can be dampened by the pulsation damper may be referred to as the cut-in frequency of the pulsation damper.

In the case that the pressure pulsations are caused by a compressor of a vapour compression system, the lengths of the tubes of the pulsation damper should preferably be selected in such a manner that it is ensured that the fundamental frequency of the compressor is higher than the cut-in frequency of the pulsation damper. Thereby it is ensured that all pressure pulsations created by the compressor can be damped by the pulsation damper.

The pulsation damper may further comprise a third tube, the third tube being arranged between the first tube and the second tube, and the third tube having a first end arranged inside the second tube at a distance from the closed end of the second tube, the second tube being fluidly connected to the third tube via the first end of the third tube. Thus, the third tube is arranged inside the second tube, and the first tube is arranged inside the third tube. The third tube may be arranged concentrically with respect to the first tube and/or the second tube. According to this embodiment, a further number of positions where reflections take place are provide in the pulsation damper. Thereby the pulsation damper defines even more resonance frequencies, and the pulsation damper is thereby capable of damping pressure pulsations within an even broader frequency range.

The second tube may be fluidly connected to the second connector via the third tube. According to this embodiment, and in the case that the first connector operates as an inlet connector and the second connector operates as an outlet connector, the fluid flow through the pulsation damper is as follows. Fluid enters the first tube via the first connector and flows into the second tube via the second end of the first tube, as described above. The fluid then enters the third tube, via the first end of the third tube, and finally leaves the pulsation damper via the third tube and the second connector.

As an alternative, the second tube may be directly connected to the second connector.

The pulsation damper may comprise further tubes, thereby defining even more resonance frequencies.

The third tube may comprise a second end arranged opposite the first end of the third tube, the second end of the third tube being fluidly connected to the second connector. According to this embodiment, the fluid flows through the third tube between the first end and the second end.

A plurality of orifices may be formed at the second end of the third tube, said orifices defining fluid passages between the third tube and the second connector. According to this embodiment, the fluid passes through the orifices when passing between the third tube and the second connector. The orifices may, e.g., be formed in a side wall of the third tube.

As an alternative, the fluid may pass between the third tube and the second connector via an open end of the third tube.

The third tube may be shorter than the first tube, the first end of the third tube thereby being arranged further away from the closed end of the second tube than the second end of the first tube. As described above, this provides many positions where reflections of pressure pulsations take place, and thereby defines many resonance frequencies of the pulsation damper. Furthermore, it is ensured that fluid flowing through the pulsation damper actually enters the second tube, rather than passing directly between the first and the third tube.

The pulsation damper may further comprise a filter device arranged in the fluid flow path through the pulsation damper. The filter device collects any loose parts that may be present in the fluid flowing through the pulsation damper. In the case that the pulsation damper is arranged in a refrigeration system, the filter device prevents that such loose parts reach the compressor, thereby preventing damage to the compressor.

The pulsation damper may be arranged inside a housing, said housing further accommodating one or more further components. The further components may, e.g., be a check valve and/or a control valve arranged to control the fluid flow through the pulsation damper. Thereby a very compact design of the pulsation damper is obtained. The housing may, e.g., be a standard housing, such as a standard valve housing. Thereby the pulsation damper can easily be mounted in a fluid flow system, e.g. a vapour compression system, by means of standard connectors.

According to a second aspect the invention provides a vapour compression system comprising a compressor, a condenser, an expansion device and an evaporator arranged along a refrigerant path, and an economizer being fluidly connected to the compressor and to the condenser, the vapour compression system further comprising an economizer line fluidly interconnecting the economizer and the compressor, the economizer line having a pulsation damper arranged therein, wherein the pulsation damper defines an expansion chamber.

It should be noted that a person skilled in the art would readily recognise that any feature described in combination with the first aspect of the invention could also be combined with the second aspect of the invention, and vice versa.

In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration, an air condition system, a heat pump, etc.

The vapour compression system comprises a compressor, a condenser, an expansion device, e.g. in the form of an expansion valve, and an evaporator arranged along a refrigerant path. Refrigerant flowing in the refrigerant path is compressed by the compressor. The compressed refrigerant is supplied to the condenser, where it is at least partly condensed, while heat exchange takes place with the ambient, e.g. in the form of a secondary fluid flow across the condenser, in such a manner that heat is rejected from the refrigerant flowing in the condenser. The refrigerant leaving the condenser is supplied to the expansion device, where it is expanded before entering the evaporator. In the evaporator the liquid part of the refrigerant is at least partly evaporated, while heat exchange takes place with the ambient, e.g. in the form of a secondary fluid flow across the evaporator, in such a manner that heat is absorbed by the refrigerant flowing through the evaporator. Finally, the refrigerant is once again supplied to the compressor. Thus, refrigerant flowing the refrigerant path is alternatingly compressed by the compressor and expanded by the expansion device, and heat exchange takes place at the condenser and the evaporator. Heating or cooling may be provided to a closed volume, due to the heat exchange at the condenser or the evaporator.

The vapour compression system further comprises an economizer being fluidly connected to the compressor and to the condenser. In the present context the term 'economizer' should be interpreted to mean a heat exchanger arranged to subcool the refrigerant flowing in the refrigerant path with the purpose of reducing power consumption of the vapour compression system. As an alternative, the economizer could be in the form of a vessel in which partly expanded refrigerant is separated into liquid and gaseous refrigerant, and where the gaseous refrigerant is supplied to the compressor, while the liquid refrigerant is supplied to the expansion device. The economizer arranged in the vapour compression system according to the second aspect of the invention is fluidly connected to the condenser and to the compressor. Thereby part of the refrigerant which leaves the condenser passes through the economizer and is supplied directly to the compressor, i.e. the expansion device and the evaporator are bypassed.

Thus, the vapour compression system comprises an economizer line fluidly interconnecting the economizer and the compressor. The economizer line has a pulsation damper arranged therein, and the pulsation damper defines an expansion chamber. Accordingly, the pulsation damper is arranged between the economizer and the compressor. In the case that the compressor creates pressure pulsations, the pulsation damper is thereby capable of damping such pulsations in the economizer line. Accordingly, the pulsation damper protects the economizer, as well as any components which may be arranged in the economizer line between the economizer and the pulsation damper, from potential damage caused by pressure pulsations created by the compressor. Furthermore, since the pulsation damper defines an expansion chamber, the pulsation damper is capable of damping pressure pulsations within a broad frequency range, as described above.

The pulsation damper may be a pulsation damper according to the first aspect of the invention. According to this embodiment, the advantages described above are obtained, and the remarks set forth above are equally applicable here.

The pulsation damper may define a fluid flow direction through the pulsation damper, which is transverse relative to a fluid flow direction in the first connector and/or the second connector. According to this embodiment, the pulsation damper protrudes from the economizer line in the sense that it is not arranged in line with the fluid flow direction at the position of the pulsation damper. This provides a compact design, and allows the pulsation damper to be easily fitted into a standard vapour compression system. Furthermore, when the fluid enters the pulsation damper, and when the fluid leaves the pulsation damper, it must perform a change of direction. This improves the damping effect of the pulsation damper.

The pulsation damper may be arranged substantially perpendicularly relative to the fluid flow direction in the first connector and/or the second connector. As an alternative, the pulsation damper may be arranged at any other angle with respect to the fluid flow direction in the first connector and/or the second connector, as long as the pulsation damper protrudes from the economizer line as described above.

The compressor may be a variable speed compressor, such as a screw compressor. Variable speed compressors may operate at varying speed, and may therefore create pressure pulsations in the fluid flow within a relatively broad frequency range. Therefore the pulsation damper of the invention is particularly useful in a vapour compression system comprising a variable speed compressor.

One or more further components may be arranged in the economizer line, and the pulsation damper may be arranged between the compressor and the one or more further components. According to this embodiment, the pulsation damper is capable of protecting the one or more further components against pressure pulsations created by the compressor. Such damage may, e.g., include structural damage to the components caused directly when pressure pulsations reach the components. Furthermore, damage may be caused due to excessive heating of the components due to the so-called 'bike pump effect', where the temperature of the refrigerant increases when the pressure of the refrigerant increases, due to the pressure pulsations. A 'bike pump effect' may, e.g., occur when the economizer line is closed, and the compressor is still running. This could, e.g., be the case when operating at a low load, where the economizer line is turned off. In this case, the compressor may still create pressure pulsations into the economizer line. This will heat the components arranged in the economizer line, and since there is not flow, there is nothing to remove the heat, and thereby the temperature of the components increases. The pulsation damper dampens the pressure pulsations and absorbs the heat. In the case that the pulsation damper has a large surface area, it will be able to easily reject the absorbed heat to the ambient.

The one or more further components could, e.g., be one or more check valves, one or more control valves, and/or one or more filters, etc.

BRIEF DESCRIPTION OF THE DRAWINGS

The invention will now be described in further detail with reference to the accompanying drawings in which.

DETAILED DESCRIPTION

Figure 1:
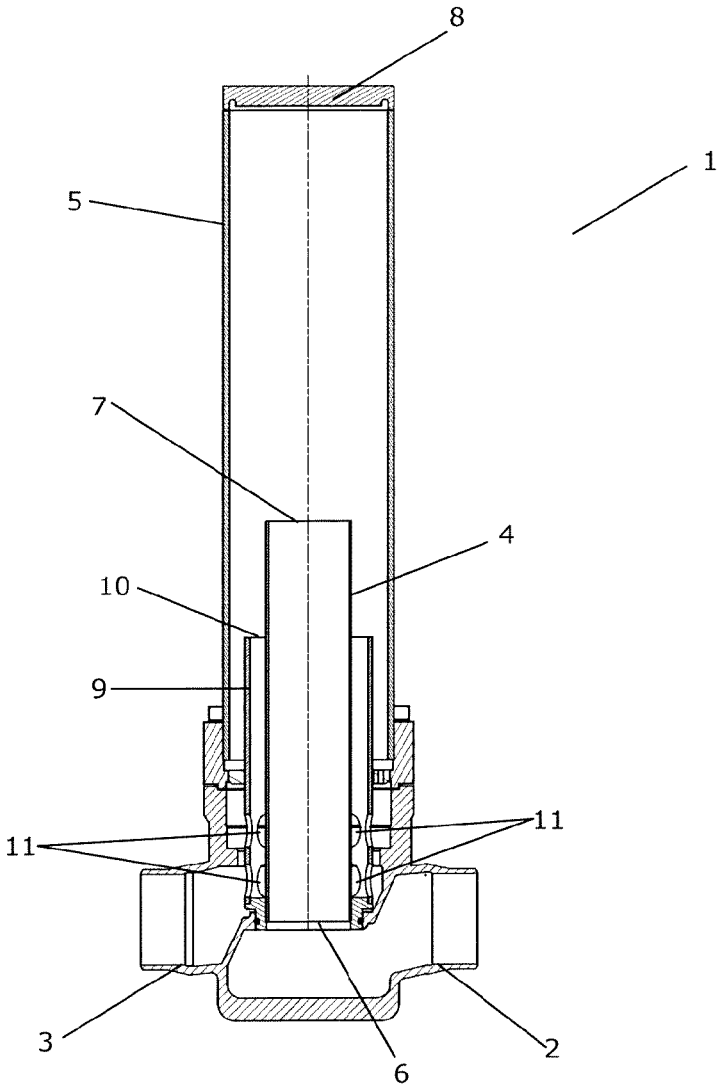
FIG. 1 is a cross sectional view of a pulsation damper according to a first embodiment of the invention.

FIG. 1 is a cross sectional view of a pulsation damper 1 according to a first embodiment of the invention. The pulsation damper 1 comprises a first connector 2 and a second connector 3, the connectors 2,3 being adapted to be connected to a fluid flow line, such as a refrigerant path of a vapour compression system.

A first tube 4 is arranged inside and concentrically with respect to a second tube 5. A first end 6 of the first tube 4 is fluidly connected to the first connector 2, and a second end 7 of the first tube 4 is fluidly connected to the second tube 5.

The second tube 5 has a closed end 8, and the second 7 end of the first tube 4 is arranged at a distance from the closed end 8 of the second tube 5. Thereby an expansion chamber is defined in the region between the second end 7 of the first tube 4 and the closed end 8 of the second tube 5.

A third tube 9 is arranged inside the second tube 5, concentrically with respect to the first tube 4 and the second tube 5. The third tube 9 is arranged between the first tube 4 and the second tube 5. The third tube 9 has a first end 10 arranged at a distance from the closed end 8 of the second tube 5, and the third tube 9 is fluidly connected to the second tube 5 via the first end 10 of the third tube 9. The third tube 9 is further fluidly connected to the second connector 3, via a number of orifices 11 formed in a side wall of the third tube 9.

Fluid flowing through the pulsation damper 1 may enter the pulsation damper 1 via the first connector 2 and the first tube 4, and enter the second tube 5 via the second end 7 of the first tube 4. The fluid may then enter the third tube 9, via the first end 10 of the third tube 9, and leave the pulsation damper 1 via the orifices 11 and the second connector 3.

As an alternative, the fluid may enter the pulsation damper 1 via the second connector 3, and enter the third tube 9 via the orifices 11. The fluid may then enter the second tube 5 via the first end 10 of the third tube 9, and continue into the first tube 4 via the second end 7 of the first tube 4, before the fluid leaves the pulsation damper 1 via the first end 6 of the first tube 4 and the first connector 2.

Pressure pulsations may be present in the fluid flow, and may propagate in a direction which is opposite to the direction of the fluid flow through the pulsation damper 1.

The third tube 9 is shorter than the first tube 4, and thereby the first end 10 of the third tube 9 is arranged further away from the closed end 8 of second tube 5 than the second end 7 of the first tube 4.

The different diameters of the first tube 4, the second tube 5 and the third tube 9 provide a number of positions along the fluid flow path through the pulsation damper 1 where reflection takes place, in the manner described above. Furthermore, since the tubes 4, 5, 9 are arranged with various distances between their ends, a number of different resonance frequencies are defined by the pulsation damper 1. Thereby the pulsation damper 1 is capable of damping pressure pulsations with a number of different frequencies. Furthermore, the expansion chamber defined between the second end 7 of the first tube 4 and the closed end 8 of the second tube 5 broadens the resonance frequencies. As a consequence, the pulsation damper 1 is capable of damping pressure pulsations within a broad frequency range.

Figure 2:
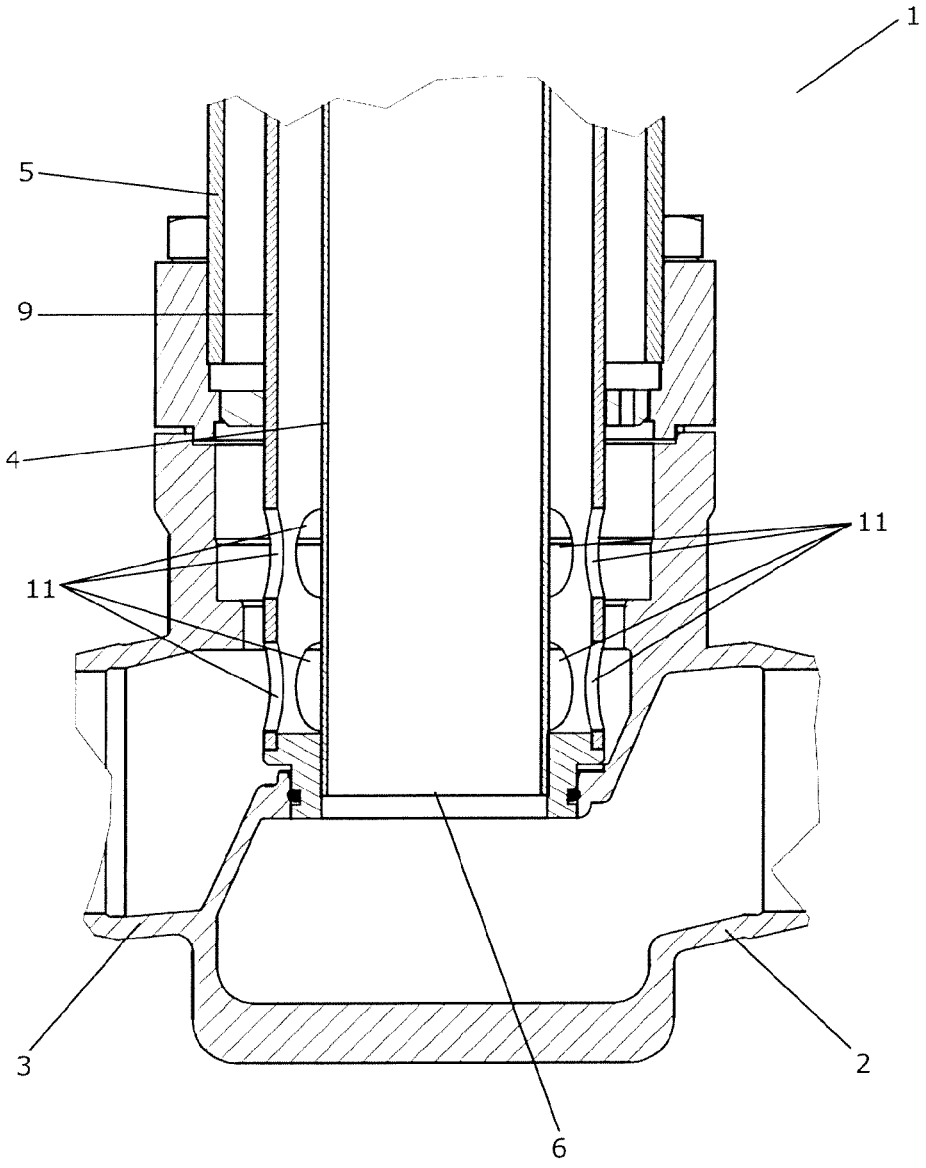
FIG. 2 shows a detail of the pulsation damper of FIG. 1.

FIG. 2 shows a detail of the pulsation damper 1 of FIG. 1. In FIG. 2 the mutual positions of the first tube 4, the second tube 5 and the third tube 9 can be easily seen. Furthermore, the orifices 11 formed in the wall part of the third tube 9 are seen in greater detail.

Figure 3:
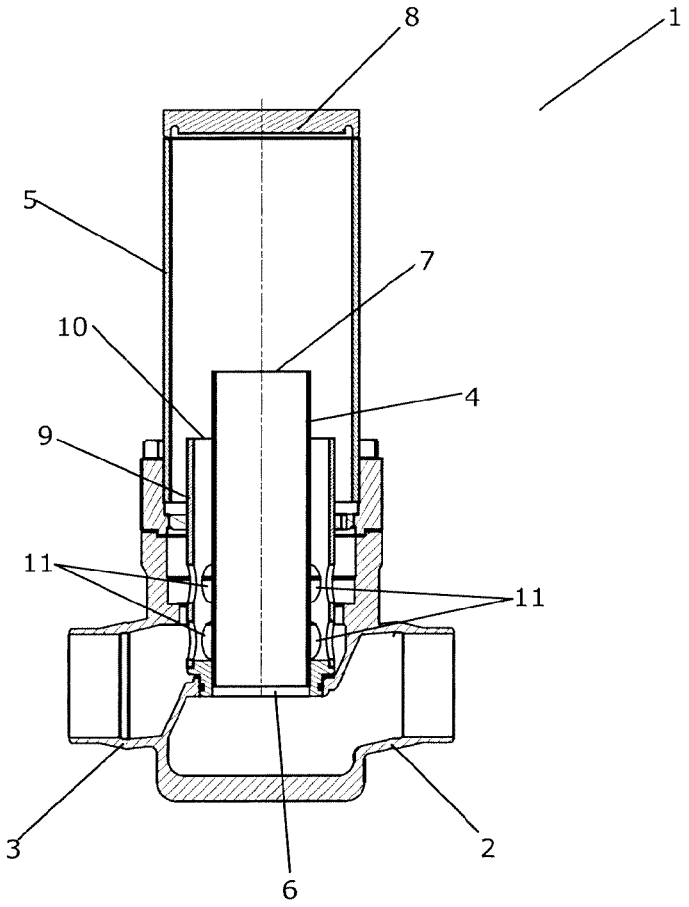
FIG. 3 is a cross sectional view of a pulsation damper according to a second embodiment of the invention.

FIG. 3 is a cross sectional view of a pulsation damper 1 according to a second embodiment of the invention. The pulsation damper 1 of FIG. 3 is similar to the pulsation damper 1 of FIG. 1, and it will therefore not be described in detail here.

In the pulsation damper 1 of FIG. 3 the second tube 5 is shorter than the second tube 5 of the pulsation damper 1 of FIG. 1. Furthermore, the distance between the second end 7 of the first tube 4 and the first end 10 of the third tube 9 is smaller in the pulsation damper 1 of FIG. 3 than in the pulsation damper 1 of FIG. 1.

Thereby the resonance frequencies defined by the pulsation damper 1 of FIG. 3 differ from the resonance frequencies defined by the pulsation damper 1 of FIG. 1. Thus, the pulsation damper 1 can be designed for damping pressure pulsations within a desired frequency range, simply by selecting the lengths of the first tube 4, the second tube 5 and the third tube 9 in an appropriate manner.

Figure 4:
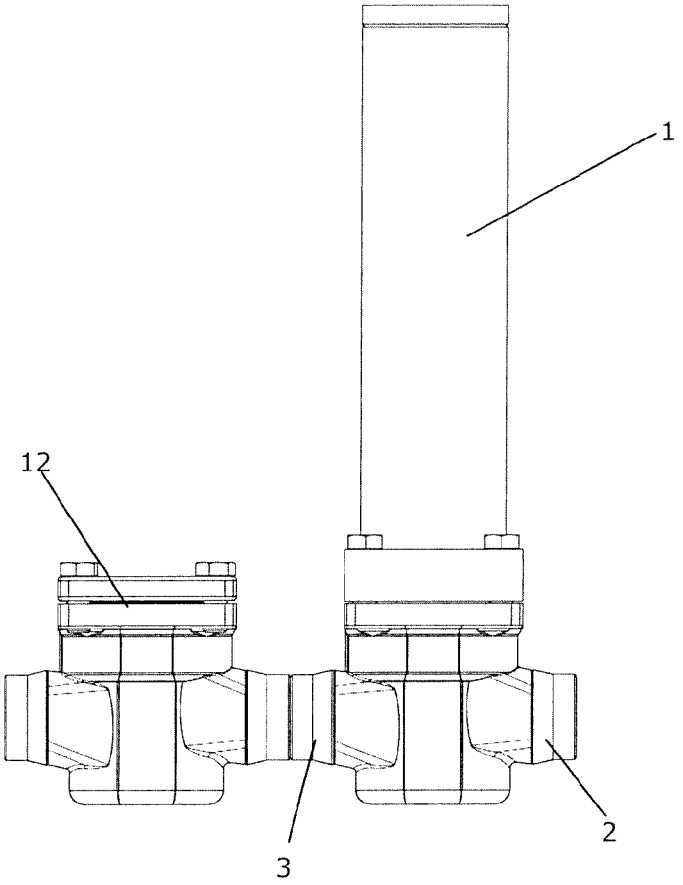
FIGS. 4 and 5 are side views of a pulsation damper arranged in an economizer line of a vapour compression system along with further components.

FIG. 4 is a side view of a pulsation damper 1 according to an embodiment of the invention, arranged in an economizer line of a vapour compression system. The pulsation damper 1 may, e.g., be of the kind shown in FIG. 1 or in FIG. 3.

The pulsation damper 1 is arranged in series with an additional component in the form of a check valve 12. The pulsation damper 1 may preferably be arranged between a compressor and the check valve 12. Thereby the pulsation damper 1 is capable of damping pressure pulsations created by the compressor, in such a manner that the check valve 12 is protected against damage caused by such pressure pulsations.

Figure 5:
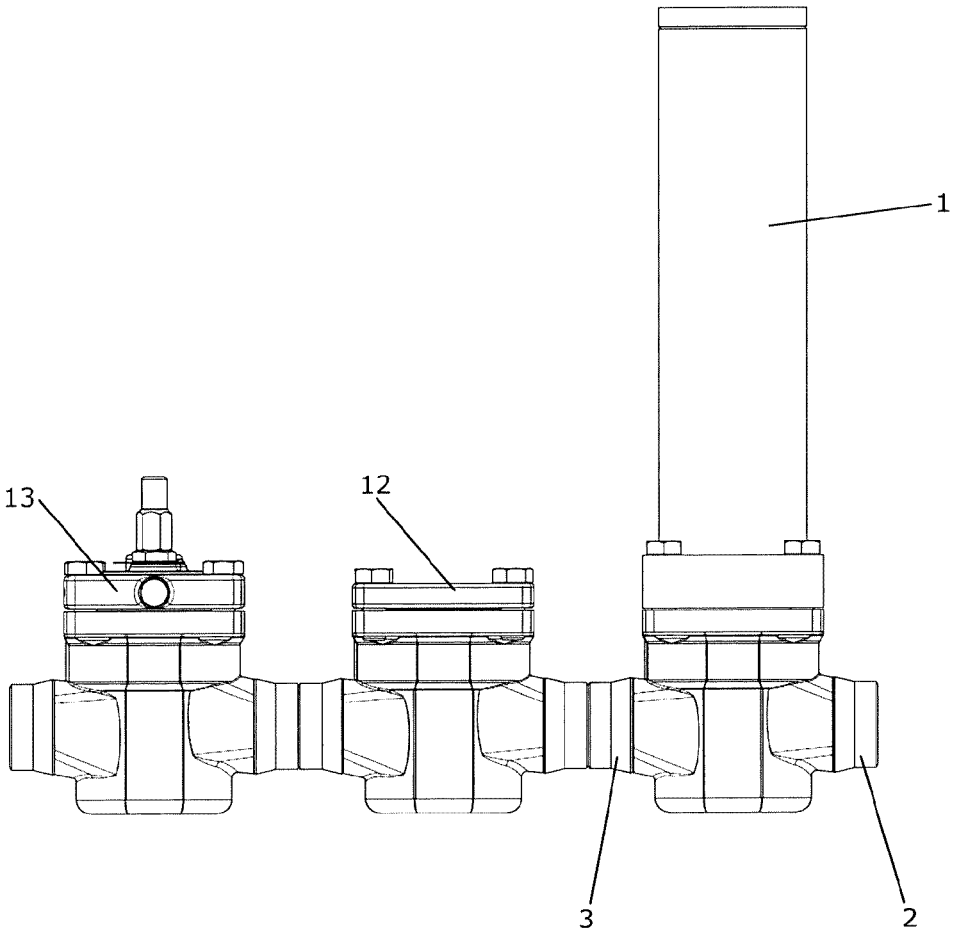

FIG. 5 is a side view of a pulsation damper 1 according to an embodiment of the invention, arranged in an economizer line of a vapour compression system. The pulsation damper 1 may, e.g., be of the kind shown in FIG. 1 or in FIG. 3.

The pulsation damper 1 is arranged in series with two additional components in the form of a check valve 12 and a control valve 13. Similarly to the situation described above with reference to FIG. 4, the pulsation damper 1 may thereby be capable of protecting the check valve 12 as well as the control valve 13 against damage caused by pressure pulsations created by a compressor.

Figure 6:
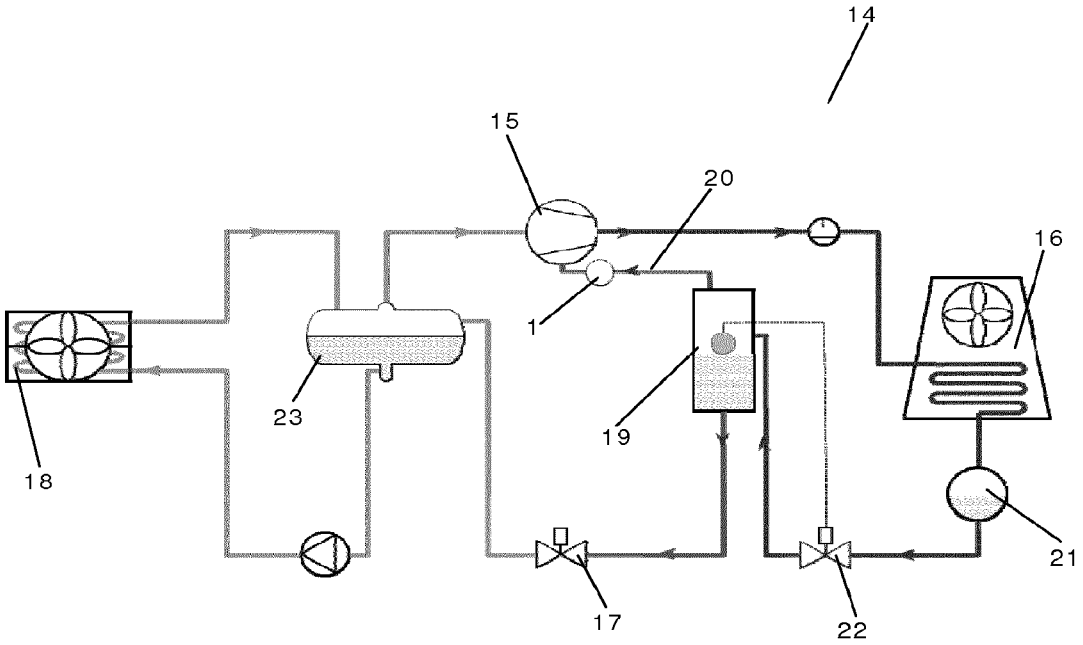
FIG. 6 is a diagrammatic view of a vapour compression system according to a first embodiment of the invention.

FIG. 6 is a diagrammatic view of a vapour compression system 14 according to a first embodiment of the invention. The vapour compression system 14 comprises a compressor 15, a condenser 16, an expansion valve 17 and an evaporator 18 arranged in a refrigerant path. The vapour compression system 14 further comprises an economizer 19 and an economizer line 20 between the economizer 19 and the compressor 15.

Refrigerant leaving the condenser 16 enters a receiver 21, and is subsequently supplied to the economizer 19 via an additional expansion valve 22. From the economizer 19 the gaseous part of the refrigerant is supplied to the compressor 15, via the economizer line 20, and the liquid part of the refrigerant is supplied to a separator 23, via the expansion valve 17.

A pulsation damper 1 is arranged in the economizer path 20, i.e. between the compressor 15 and the economizer 19. The pulsation damper 1 may, e.g., be of the kind illustrated in FIG. 1 or in FIG. 3.

The pulsation damper 1 is capable of protecting other components of the vapour compression system 14 against damage caused by pressure pulsations created by the compressor 15, in the manner described above.

Figure 7:
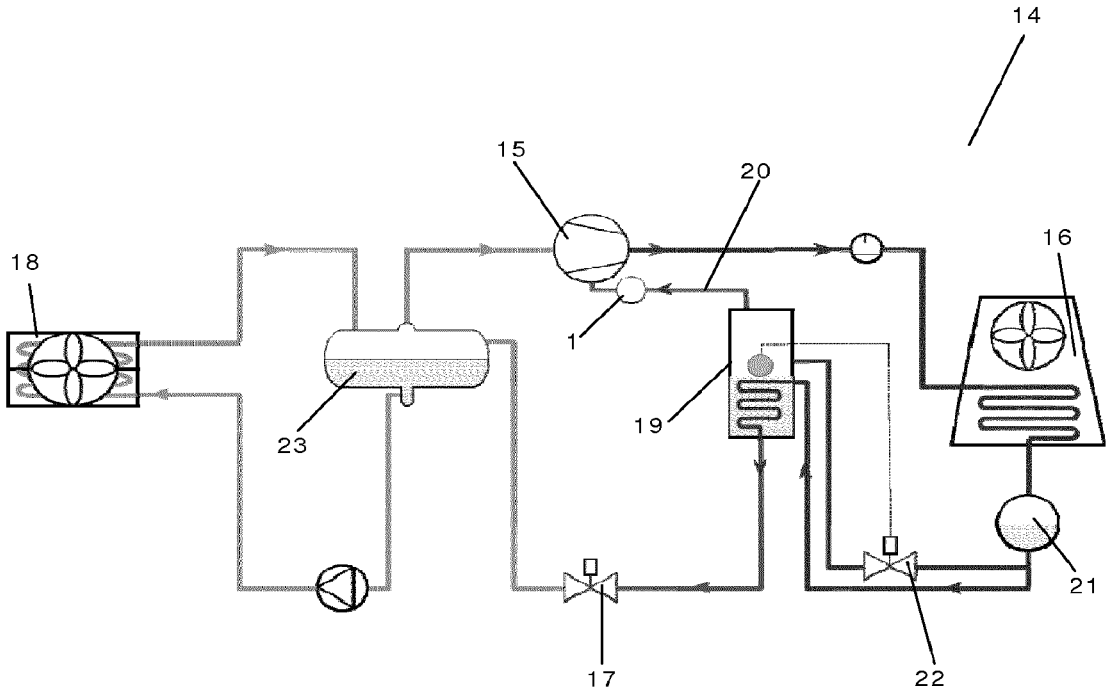
FIG. 7 is a diagrammatic view of a vapour compression system according to a second embodiment of the invention.

FIG. 7 is a diagrammatic view of a vapour compression system 14 according to a second embodiment of the invention. The vapour compression system 14 of FIG. 7 is similar to the vapour compression system 14 of FIG. 6, and it will therefore not be described in detail here.

In the vapour compression system 14 of FIG. 7 refrigerant leaving the condenser 16 is separated in the receiver 21. Part of the refrigerant is then supplied to the economizer 19, via the additional expansion valve 22, and part of the refrigerant is supplied to the separator 23, via the expansion valve 17. The refrigerant being supplied to the expansion valve 17 is led past or through the economizer 19 in such a manner that heat exchange takes place with the refrigerant which is supplied to the economizer 19.

Figure 8:
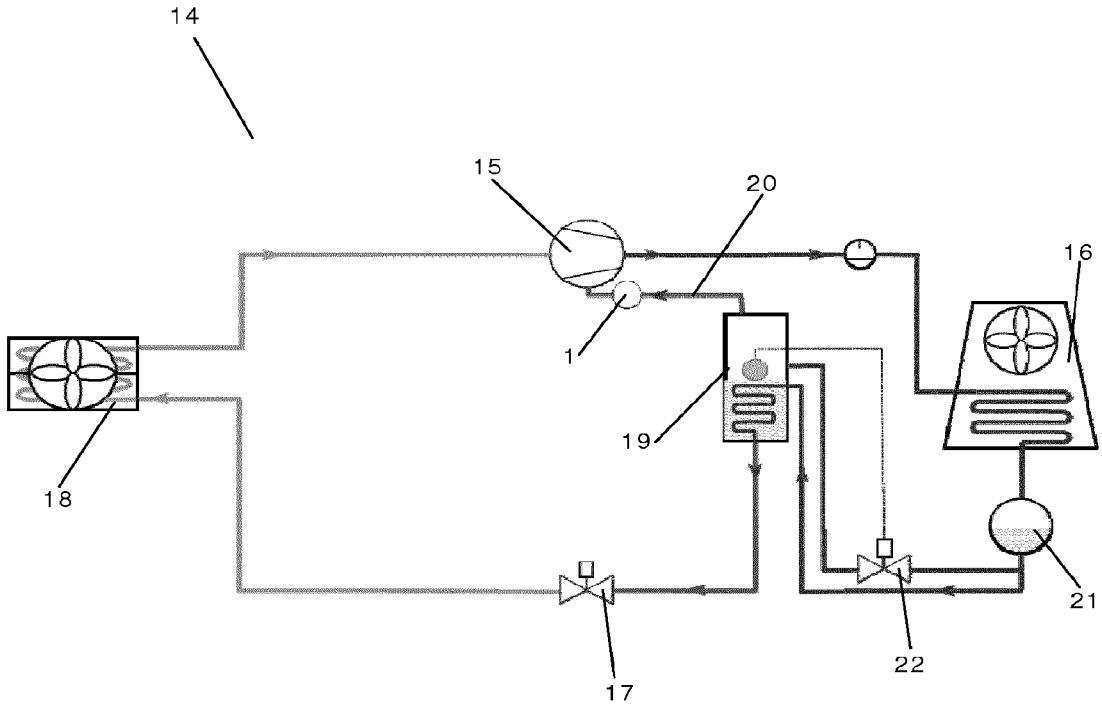
FIG. 8 is a diagrammatic view of a vapour compression system according to a third embodiment of the invention.

FIG. 8 is a diagrammatic view of a vapour compression system 14 according to a third embodiment of the invention. The vapour compression system 14 of FIG. 8 is similar to the vapour compression system 14 of FIG. 7, and it will therefore not be described in detail here.

The vapour compression system 14 of FIG. 8 does not have a separator arranged between the expansion valve 17 and the evaporator 18. Thus, the refrigerant is supplied directly from the expansion valve 17 to the evaporator 18.

Figure 9:
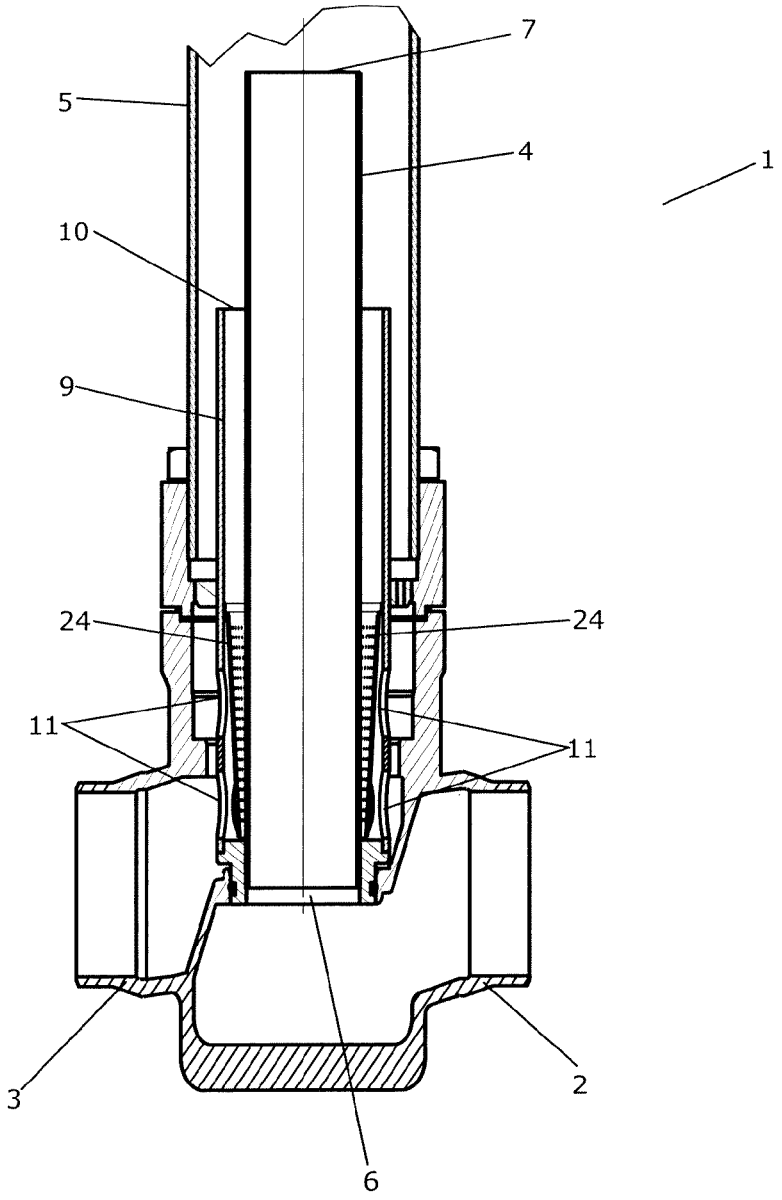
FIG. 9 is a cross sectional view of a pulsation damper according to a third embodiment of the invention.

FIG. 9 is a cross sectional view of a pulsation damper 1 according to a third embodiment of the invention. Only a part of the pulsation damper 1 is shown in FIG. 9. The pulsation damper 1 of FIG. 9 is very similar to the pulsation dampers 1 of FIGS. 1-3, and it will therefore not be described in detail here.

The pulsation damper 1 of FIG. 9 comprises a filter device 24 arranged inside the third tube 9, at a position near the orifices 11. Thereby, fluid flowing through the third tube 9 between the first end 10 of the third tube 9 and the orifices 11 passes through the filter device 24. Accordingly, the filter device 24 is capable of catching any loose parts which may be present in the fluid flowing through the pulsation damper 1. Thereby it may be prevented that such loose parts reach other components, such as a compressor.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A pulsation damper comprising:

a first connector and a second connector, each arranged to be connected into a fluid flow line in such a manner that fluid is received in the pulsation damper from the fluid flow line via the first or the second connector, and fluid is delivered to the fluid flow line from the pulsation damper via the second or first connector, a first tube having a first end being fluidly connected to the first connector and a second end arranged opposite the first end, a second tube, the first tube being arranged inside the second tube, the second tube having a closed end, wherein the second end of the first tube is arranged inside the second tube at a distance from the closed end of the second tube, the first tube being fluidly connected to the second tube, via the second end of the first tube, and the second tube being fluidly connected to the second connector, and a third tube, the third tube being arranged between the first tube and the second tube, and the third tube having a first end arranged inside the second tube at a distance from the closed end of the second tube, the second tube being fluidly connected to the third tube via the first end of the third tube, wherein the pulsation damper defines a fluid flow path through the pulsation damper from the first or second connector to the second or first connector, via the first tube and the second tube, and wherein the first tube is arranged inside the third tube and the third tube is arranged inside the second tube.

2. The pulsation damper according to claim 1, wherein the second tube is fluidly connected to the second connector via the third tube.

3. The pulsation damper according to claim 2, wherein the third tube comprises a second end arranged opposite the first end of the third tube, the second end of the third tube being fluidly connected to the second connector.

4. The pulsation damper according to claim 2, wherein the third tube is shorter than the first tube, the first end of the third tube thereby being arranged further away from the closed end of the second tube than the second end of the first tube.

5. The pulsation damper according to claim 2, further comprising a filter device arranged in the fluid flow path through the pulsation damper.

6. The pulsation damper according to claim 3, wherein the third tube is shorter than the first tube, the first end of the third tube thereby being arranged further away from the closed end of the second tube than the second end of the first tube.

7. The pulsation damper according to claim 3, further comprising a filter device arranged in the fluid flow path through the pulsation damper.

8. The pulsation damper according to claim 3, wherein a plurality of orifices are formed at the second end of the third tube, said orifices defining fluid passages between the third tube and the second connector.

9. The pulsation damper according to claim 8, wherein the third tube is shorter than the first tube, the first end of the third tube thereby being arranged further away from the closed end of the second tube than the second end of the first tube.

10. The pulsation damper according to claim 8, further comprising a filter device arranged in the fluid flow path through the pulsation damper.

11. The pulsation damper according to claim 1, wherein the third tube is shorter than the first tube, the first end of the third tube thereby being arranged further away from the closed end of the second tube than the second end of the first tube.

12. The pulsation damper according to claim 1, further comprising a filter device arranged in the fluid flow path through the pulsation damper.

13. The pulsation damper according to claim 1, wherein the pulsation damper is arranged inside a housing, said housing further accommodating one or more further components.

14. The pulsation damper according to claim 1, wherein the first tube is arranged concentrically within the second tube.

15. The pulsation damper according to claim 14, wherein the third tube is arranged concentrically with respect to the first tube and the second tube.

* * * * *